United States Patent [19]

Kakar et al.

[11] 4,208,463

[45] Jun. 17, 1980

[54] NON-DURABLE FLAME-REPELLENT FINISH FOR SYNTHETIC FABRICS AND SYNTHETIC-COTTON BLENDS

[75] Inventors: Sarwan K. Kakar, Southgate; John J. Cramer, Wyandotte, both of Mich.

[73] Assignee: BASF Wyandotte Corporation, Wyandotte, Mich.

[21] Appl. No.: 656,116

[22] Filed: Feb. 9, 1976

[51] Int. Cl.[2] ..... B05D 3/02; B32B 7/00; B32B 9/00

[52] U.S. Cl. ..... 428/276; 8/116 P; 106/15.05; 252/8.1; 427/394; 428/921

[58] Field of Search ..... 427/390 D, 394; 428/921, 276; 8/116 P; 252/8.1; 106/15 FP, 15.05

[56] References Cited

U.S. PATENT DOCUMENTS

| | | | |
|---|---|---|---|
| 2,032,605 | 3/1936 | Whitehead | 428/921 X |
| 2,415,112 | 2/1947 | Seymour et al. | 428/921 X |
| 2,526,462 | 10/1950 | Edelstein | 428/276 |
| 3,085,029 | 4/1963 | Miles et al. | 428/276 |
| 3,565,679 | 2/1971 | Strother | 428/276 |
| 3,644,083 | 2/1972 | Stockel et al. | 427/394 X |
| 3,855,138 | 12/1974 | Roth | 252/8.1 |
| 3,935,343 | 1/1976 | Nuttall | 428/921 X |

FOREIGN PATENT DOCUMENTS

| | | | |
|---|---|---|---|
| 989140 | 4/1965 | United Kingdom | 428/276 |

*Primary Examiner*—Michael R. Lusignan
*Attorney, Agent, or Firm*—John W. Linkhauer

[57] ABSTRACT

Compositions based upon monoammonium phosphate and/or diammonium phosphate together with monoethanolamine and/or diethanolamine are used to provide a flame-retardant finish to synthetic fabrics or synthetic-cotton blends. Good flame-retardant protection is obtained with a dry add-on of approximately 13 to 15 percent, and the fabric retains a good hand.

6 Claims, No Drawings

NON-DURABLE FLAME-REPELLENT FINISH FOR SYNTHETIC FABRICS AND SYNTHETIC-COTTON BLENDS

BACKGROUND OF THE INVENTION

1. Field of the Invention

This invention relates to a method for providing a non-durable flame-retardant finish to fabrics, and in particular, to synthetic fabrics such as polyesters and blends of polyesters with natural fabrics such as cotton.

2. Description of the Prior Art

Much work has been done in the field of providing fabrics with a treatment that will render them flame-retardant. In early work, it was learned that it would be possible to provide a fabric with flame-retardant characteristics by treating it with boric acid, borax, or mixtures thereof, alone or with an added diammonium phosphate. Such compositions provide a non-durable flame-retardant coating, i.e., the treatment is effective only until the fabric is laundered. Some of such compositions impart to the fabric so treated an undesirably harsh feel or "hand". Moreover, in some instances, the amount that it is necessary to use of the flame-retardant material is sufficiently great that the fabric is discolored by the powdery, flame-retardant material remaining on the fabric after it has been treated and dried, and powder tends to come off the fabric; this is obviously undesirable in connection with providing flame-retardant characteristics to garments intended to be worn. Considerable work has been done in the direction of providing a flame-retardant finish which will be durable, i.e., will survive a few washings or a few dozen washings. Recently, relatively little attention has been paid to the area of providing non-durable flame-retardant finishes for fabrics, despite the fact that the "durable treatment" tends to be relatively expensive while at the same time it is often questionable, after a few washings, how much of the desired flame-retardant effect remains. There has been need for a method of treating fabrics to impart flame-retardant properties to them which is easy to practice and relatively inexpensive.

In the last twenty or thirty years, synthetic fabrics such as polyester or nylon or blends of such synthetic fabrics with cotton have replaced cotton and wool in garments commonly worn by the public. This has made it substantially more difficult to solve the problem of providing a satisfactory non-durable flame-retardant finish which can be applied to such fabrics. From the standpoint of avoiding expense in providing a fabric with a flame-retardant finish, it is certainly desirable to have a composition which is based upon water, so that the fabric, as a final step of a laundering operation, can be immersed in an aqueous composition and then wrung or spin-dried to leave an adequate proportion (add-on) of treatment material in the fabric. Unfortunately, the synthetic fabrics are, in comparison with natural fabrics such as cotton or wool, relatively water-repellent or hydrophobic. Many treatments which are known to be quite satisfactory for use with cotton simply do not work with polyester or nylon. In point of fact, the applicants are not aware of any treatment, known prior to the present invention, which uses an aqueous solution and provides a satisfactory non-durable flame-retardant finish to polyester, nylon, or blends of cotton with synthetic fiber.

SUMMARY OF THE INVENTION

Compositions based upon monoammonium phosphate and/or diammonium phosphate together with monoethanolamine and/or diethanolamine are used to provide a flame-retardant finish to synthetic fabrics or synthetic-cotton blends. Good flame-retardant protection is obtained with a dry add-on of approximately 13 to 15 percent, and the fabric retains a good hand.

DESCRIPTION OF THE PREFERRED EMBODIMENTS

The first step in the practice of the invention is the making of a suitable aqueous solution for use in imparting flame retardancy to fabrics in accordance with the invention. This is done by mixing (a) monoammonium phosphate and/or diammonium phosphate, (b) monoethanolamine and/or diethanolamine, and (c) water. Certain proportions are to be observed. The alkanolamine:phosphate ratio in parts by weight is at least 5:95 and may be as great as 30:70; satisfactory results are usually obtained with a ratio of 20:80. These ingredients are put into water; usually, about 20 parts by weight of alkanolamine plus phosphate to 80 parts by weight of water will give a good result, but those skilled in the art will understand that this ratio may be varied to some extent. The concentration of the solution may be increased to the point where the solubility limit is reached, and it may be decreased, within limits, considering the amount of add-on that it is desired to achieve in treating the fabric, as will be discussed below. The mixing of the necessary ingredients presents no problem; it can be done at room temperature in any suitable sort of vessel.

Not all the compositions made in accordance with the foregoing instructions are equally suitable. There is some basis, in certain circumstances, for choosing between monoammonium phosphate and diammonium phosphate: monoammonium phosphate, when dissolved in water, is more acidic than diammonium phosphate, and if it is intended that the composition made be one that can be used for the treatment of not only synthetics and synthetic-cotton blends but also straight cottons, there can arise the problem that the overall composition is too acidic for use with straight cotton. A composition for use with straight cotton should not have a pH lower than about 6; otherwise, it is likely that the strength of the fabric will be impaired. Moreover, although both monoethanolamine and diethanolamine usually are quite suitable, so that either of them or mixtures of them may be used, there are circumstances in which one or the other may be preferable. In an atmosphere which is quite dry, the compositions made with diethanolamine are often to be preferred, because under such circumstances the monoethanolamine-containing compositions sometimes cause the treated fabric to feel somewhat harsher than fabric treated with a diethanolamine-containing composition. On the other hand, in atmospheres of moderate humidity and at a given level of add-on, other things being equal, the hand of the fabric is often better with a monoethanolamine-containing composition than with a diethanolamine-containing composition.

In general, it is desirable to use a composition having a pH between 6 and 8, i.e., substantially neutral. As mentioned above, there is a problem if the composition is too acidic, and if the composition is too basic, the fabric may discolor upon ironing or it may give problems later if it comes into contact with human skin. For some purposes, the matter of pH is not important; for example, one might apply a flame-retardant treatment to a tent fabric made of synthetic material—it is neither ironed nor worn, and the contact between the user and the fabric is minimal, and in such case, the pH distinction is considerably less important.

In most instances, the composition will consist of exactly the ingredients mentioned above. If the pH is to be adjusted by the addition of a base, it is certainly desirable to use either ammonium hydroxide or more of the amine, rather than sodium hydroxide. Alkali-metal hydroxide is not the equivalent of ammonium hydroxide in this context, because alkali-metal hydroxide contains mineral and leaves ash, whereas ammonium hydroxide or additional amine does not. In all cases, the composition used consists essentially of the various ingredients in the proportions mentioned above, though it is within the scope of the invention to include in the composition some amounts of optional ingredients such as perfumes, dyes, stabilizers, fabric softeners, optical brighteners, etc., to the extent that they are otherwise compatible with the compositions. In general, it is desirable to avoid the use of additional ingredients which contain any substantial proportion of carbon, since carbon-containing ingredients tend to make the flame retardance poorer.

In most instances, good results can be obtained with a composition of 80 parts water, 16 parts diammonium phosphate, and 4 parts monoethanolamine. Such a composition is useful for the treatment of straight cotton as well as the blends and the synthetics.

The next step is that of applying the composition to the fabric to be treated. This can be done in various ways, such as spraying the composition onto the fabric, or immersing the fabric in the composition and then, to the proper extent, removing the composition from the fabric by wringing or spin-drying. The important consideration in this operation is that of achieving a proper amount of add-on for the fabric to be treated.

Add-on can be measured by weighing the fabric dry before it is treated and weighing it dry again after it is treated, and determining the percent gain in weight.

The percent of add-on should be great enough to give the desired flame-retardant effect, and it should not be so great that the material acquires a poor "hand", or so great that the treating composition is being wasted. Enough to give the desired effect is, for example, 8.5 percent add-on for cottons, 13.5 percent for blends of cotton and synthetic, and 15 percent for pure synthetics. The percent of add-on is influenced by the concentration of the composition used, the manner of application, and the manner and extent of composition removal after treatment (wringing, spin-drying, drip-drying) if such is used.

After the composition is applied and removed to the extent desired, the fabric is dried. This step can comprise a simple drying in air at ambient temperature, or it can comprise an artificial drying, such as the drying obtained in a household clothes dryer or its various commercial-laundry equivalents.

There is thus produced a fabric which (a) does not have an undesirably "boardy" or stiff feel, (b) has not been subjected to a treatment which is inordinately expensive, and (c) has quite a considerable degree of flame-retarded character.

In regard to the matter of whether a swatch of fabric has been flame-retarded or not, and whether the flame-retardant treatment which has been provided to the fabric is still effective to some reasonable extent, there is the test of attempting to burn the swatch by applying a lighted match to its bottom, while holding it vertically, for a period of three seconds. Any fabric which has no treatment (cotton, blend, or synthetic) will, in such a test, simply all burn up. A piece of fabric with quite a good treatment on it will, in contrast, exhibit 5 to 20 millimeters of charred area in the vicinity of where the match was held, but go out promptly when the match is removed. In between, there are treatments of such marginal effectiveness as to give a char length such as 18 to 50 millimeters and a time to extinguishment of visible flame of 10 to 50 seconds. Fabrics treated according to this invention usually are quite good or excellent, and in any event they do not have visible flame as long as 3 seconds after the match is removed.

The invention described above is illustrated by the following specific examples and comparison tests, in which parts are by weight unless otherwise specified.

EXAMPLE 1

A composition was prepared which consisted of 80 parts water, 16 parts diammonium phosphate, and 4 parts monoethanolamine. This composition was applied to a swatch of polyester material (polyethylene glycol terephthalate) under conditions such that an add-on of 15 percent was obtained. After being dried, the fabric was observed and tested. It was not discolored, and to the hand it did not feel substantially different from a similar swatch of untreated material. When subjected to a flame test as described above (a lighted match held at the bottom edge of the swatch for three seconds), it extinguished immediately when the match was removed, and the char length was small, about 3 millimeters.

EXAMPLE 2

Example 1 was repeated, except that the fabric used was a polyester-cotton blend containing 65 percent of polyester and 35 percent of cotton, and the percent add-on was 13.5 percent. The results were the same: a hand indistinguishable from untreated fabric and excellent results in a flame test.

EXAMPLE 3

Example 1 was repeated, except that the fabric was nylon. The results were the same.

EXAMPLE 4

Example 1 was repeated, except that monoammonium phosphate was used in place of diammonium phosphate. The results were the same.

EXAMPLE 5

Example 2 was repeated, except that monoammonium phosphate was used in place of diammonium phosphate. The results were the same.

EXAMPLE 6

Example 3 was repeated, except that monoammonium phosphate was used in place of diammonium phosphate. The results were the same.

EXAMPLE 7

Example 1 was repeated, except that diethanolamine was used in place of monoethanolamine. The results were not quite the same. To the hand, the fabric was slightly stiffer than similar untreated material, having a stiffness such as that of a lightly starched shirt. The treatment is still considered a useful one, becaue there are applications in which such stiffness is tolerable or even desirable. In the flame test, the results were substantially the same.

EXAMPLE 8

Example 7 was repeated, except that the fabric treated was, as in Example 2, a blend of polyester and cotton, and the percent of add-on used was 13.5 percent. The results were the same as in Example 7.

EXAMPLE 9

Example 7 was repeated, except that the fabric treated was nylon. The results were the same as in Example 7.

TEST A

Example 1 was repeated, except that triethanolamine was substituted for monoethanolamine. Although in the flame test excellent results were obtained, the treated material had a harsh, boardy feel, so that the treatment is an unsuitable one.

TEST B

Example 1 was repeated, except that the fabric treated was cotton and the percent of add-on was 8 percent. The results were the same as in Example 1: excellent flame retardance and a hand substantially indistinguishable from that of untreated fabric. This test demonstrates how much more easily pure cotton can be treated than synthetic fibers or synthetic-cotton blends.

TEST C

Example 1 was repeated, except that the percent of add-on was 13.5 percent. The hand of the treated fabric was satisfactory, but in a flame test, the fabric did not self-extinguish immediately upon the removal of the match, but rather burned for several seconds and exhibited a charred area extending inward from the edge of the fabric by 7 or 8 millimeters. This test indicates the necessity of using a percent of add-on sufficient to impart the desired flame-retardant characteristics, and it indicates that in the case of pure polyester, an add-on of approximately 15 percent is required.

TEST D

Example 1 was repeated, except that the fabric treated was a polyester-cotton blend as in Example 2, and the percent of add-on was 11 percent. The results were substantially the same as in Test C.

Test E

A composition was prepared which consisted of 80 parts of water, 16 parts of monoammonium phosphate, and 4 parts of monoethanolamine. A pure cotton fabric was treated with such composition, with an add-on of 8 percent. The fabric so treated was dried and observed. It exhibited a satisfactory hand and excellent performance in a flame test, but the mechanical strength of the fabric was greatly impaired; it was easily possible to tear the fabric, whereas none of the treated fabrics of the Examples and Tests mentioned above gave any such result. This test illustrates the desirability in connection with the preparation of compositions which may be intended for general use, treating not only synthetics or synthetic-cotton blends but also pure cotton, of adjusting the pH of the composition so that it does not lie too far from neutral upon the acid side. Although pure synthetic fabrics and synthetic-cotton blends will retain their strength despite being treated with compositions having a pH such as 5.5 or even 4.0, pure cotton tends to lose its mechanical strength if treated with a composition having a pH lower than about 6.0.

While we have shown and described herein certain embodiments of our invention, we intend to cover as well any change or modification therein which may be made without departing from its spirit and scope.

The embodiments of the invention in which an exclusive property or privilege is claimed are defined as follows:

1. A method for providing a fabric containing at least 50 percent of synthetic fiber with a non-durable flame-retardant treatment while the fabric retains satisfactory hand properties, said method comprising applying to said fabric an effective amount of a composition consisting essentially of 10 to 30 parts by weight of an alkanolamine selected from the group consisting of monoethanolamine and diethanolamine and 90 to 70 parts by weight of material selected from the group consisting of monoammonium phosphate, diammonium phosphate, and mixtures thereof.

2. A method for providing a fabric containing at least 50 percent of synthetic fiber with a non-durable flame-retardant treatment while the fabric retains satisfactory hand properties, said method comprising applying to said fabric an effective amount of a composition consisting essentially of 80 parts by weight of water, 2 to 6 parts by weight of an alkanolamine selected from the group consisting of monoethanolamine and diethanolamine, and 18 to 14 parts by weight of material selected from the group consisting of monoammonium phosphate, diammonium phosphate, and mixtures thereof.

3. A method as defined in claim 2, characterized in that said fabric is of nylon or of polyethylene glycol terephthalate polyester, and that approximately 15 weight percent dry add-on is used.

4. A method as defined in claim 2, wherein the fabric treated is a blend of cotton and polyester, and approximately 13.5 weight percent of add-on is used.

5. A method according to claim 2, wherein monoethanolamine is used as the alkanolamine.

6. A method as defined in claim 5, wherein diammonium phosphate is used as the phosphate.

* * * * *